US011926016B2

(12) United States Patent
Belpanno et al.

(10) Patent No.: US 11,926,016 B2
(45) Date of Patent: Mar. 12, 2024

(54) BURNISHING DEVICES ADAPTED FOR USE IN SMALL DIAMETER PIPES

(71) Applicant: Brinkman Products, Inc., Rochester, NY (US)

(72) Inventors: Sandro G. Belpanno, Spencerport, NY (US); Peter R. Diliberto, Rochester, NY (US); Paul W. Allart, Pittsford, NY (US)

(73) Assignee: Brinkman Products, Inc., Rochester, NY (US)

( * ) Notice: Subject to any disclaimer, the term of this patent is extended or adjusted under 35 U.S.C. 154(b) by 79 days.

(21) Appl. No.: 17/778,880

(22) PCT Filed: May 10, 2019

(86) PCT No.: PCT/US2019/031809
§ 371 (c)(1),
(2) Date: May 23, 2022

(87) PCT Pub. No.: WO2020/231394
PCT Pub. Date: Nov. 19, 2020

(65) Prior Publication Data

US 2023/0001537 A1 Jan. 5, 2023

(51) Int. Cl.
*B24B 39/02* (2006.01)
*B24B 47/14* (2006.01)

(52) U.S. Cl.
CPC ..... *B24B 39/02* (2013.01); *B24B 47/14* (2013.01)

(58) Field of Classification Search
CPC ..... B24B 39/02; B24B 47/14
See application file for complete search history.

(56) References Cited

U.S. PATENT DOCUMENTS 9,539,697 B2 * 1/2017 Belpanno ..... B23G 7/02
2018/0009082 A1 * 1/2018 Farrell ..... B23P 9/00

FOREIGN PATENT DOCUMENTS

CA 3005724 A1 * 11/2018 ..... B24B 39/02
WO WO-2016200082 A1 * 12/2016

* cited by examiner

*Primary Examiner* — Rick K Chang
(74) *Attorney, Agent, or Firm* — Phillips Lytle LLP; David L. Principe

(57) ABSTRACT

Devices (10) for burnishing a surface (111, 112) on an object (108) includes a body (11) having a passageway (25), an accumulator piston (65) mounted on the body for sealed sliding movement within the passageway, a coarse adjustment screw (13) mounted on the body, a resilient member (14) acting between the coarse adjustment screw and the accumulator piston, a lever (12) mounted on the body, a chamber (32) communicating with the accumulator piston, an actuator piston (78) mounted on the body for sealed sliding movement within a cylindrical opening (41) toward and away from the rearward portion (48) of the lever, and a roll (15) rotatably mounted on the forward portion (49) of the lever. The devices are adapted to be mounted on a machine tool (105) and moved toward the object to burnish the surface with controllable force along the required length of the surface.

13 Claims, 4 Drawing Sheets

BURNISHING DEVICES ADAPTED FOR USE IN SMALL DIAMETER PIPES

TECHNICAL FIELD

This invention relates generally to devices for burnishing a surface on an object (e.g., in pipe used in the natural gas industry), and, more particularly, to improved cold root-rolling devices that are adapted for use with smaller diameter threaded pipes.

BACKGROUND ART

In the petroleum and natural gas industries, lengths of pipe are threaded together to form a drill-string (i.e., a length of series-connected pipes). However, with the increasing popularity of extended-reach drilling, multi-lateral wells, and horizontal well applications, the stress and bending moments that are placed on the threaded connections in a drill-string are increased. The increased number of pipe connections and increased stresses contribute to an increased chance of a downhole failure of the drill-string. The cost of repairing a single downhole failure may exceed one million dollars.

Cold root-rolling is the process of burnishing the root radius of a freshly-cut or previously-cut thread in a rotary shouldered connection. A hardened roll, similar in profile to the thread being burnished, is forced into contact with the thread. Pressure is applied to cause the hardened roll to penetrate into the surface of the thread. This deforms and cold-works the material, imparts an improved surface finish to the thread, and compacts and displaces the grains of the thread material.

Industry experience has suggested that cold root-rolling may increase the fatigue life of a threaded connection from three to five times over a similar unrolled threaded connection under the same working conditions. One industry study has noted laboratory results suggesting that an improvement in fatigue life of up to twenty-seven times may result from the cold root-rolling process. See, e.g., Knight, M. J., Brennan, F. P. and Dover, W. D., "Fatigue Life Improvement of Threaded Connections by Cold Rolling", *Journal of* Strain *Analysis*, vol. 40, pp. 83-93 (Sep. 30, 2004). This study has attributed the increase in fatigue life to one or more of the following factors:

(1) Cold root-rolling creates a thin zone of residual compressive stress in the root region of the thread. This residual compressive stress may offset tensile stresses produced in service, and may lower the overall stress in the critical stress region of the thread root.

(2) The burnishing effect of the smooth and hardened roll causes small scratches and ridges left by the thread-cutting operation to flatten into a more-uniform surface. These scratches may have small tip radii, and are believed to be the source of considerable stress concentrations. As a result, these scratches appear to be crack propagation starting points for fatigue failures.

(3) Scratches provide prime locations for chemical erosion. The microscopic surface of a scratch is very jagged and porous. This exposes a large surface area, and numerous molecular bonding sites, to the corrosive effects of liquids and gasses used in a drill-string environment. Burnishing smoothes the scratched surface, and reduces outcroppings and inclusions. It tends to reduce the area of the surface, and densely compresses the same.

(4) Cold root-rolling has a work-hardening effect of the surface of the material. On an atomic scale, compressive displacement of the crystalline lattice within the steel grain structure is believed to cause the crystal structure to change from a repetitive and uniform atomic structure to one with many dislocations in the pattern. These dislocations are believed to cause the crystal structure to interlock, and to become more resistant to further deformation. This increased resistance to further deformation helps to prevent cracks from starting, and helps to arrest microscopic cracks from growing into structural flaws that might threaten the integrity of the threaded joint. In laboratory studies, cracks that have occurred in cold root-rolled threaded joints have exhibited significantly-lower crack aspect ratios (i.e., the ratio of crack length to crack depth). A 30%-50% reduction in this ratio suggests that cracks that have occurred in cold root-rolled joints are more likely to be deep and short, rather than long and shallow. A long and shallow crack is believed to be more likely to lead to a sudden and complete structural failure of the threaded joint. A deep crack that partially penetrates the section wall is detectable via the pressure drop of circulating drilling fluids, and allows for an early recovery of a damaged drill-string prior to a complete structural failure of the joint.

Because of the foregoing advantages, cold root-rolling is now commonly performed on many freshly-cut and re-cut threads used on drill-string pipes used in the petroleum and natural gas industries. It is a money-saving process. It can dramatically increase the fatigue life of each rotary-shouldered threaded connection in a typical drill-string. It can also reduce the frequency of repairing connections in the field, and of having to fish for downhole drill-string failures.

One line of cold root-rolling products is the 11069 Series Internal Thread Bar-Style Tools, available from Brinkman Products, Inc., 167 Ames Street, Rochester, N.Y. 14611. Such tools are designed for root-rolling pipes having an inner diameter as small as about 3½ inches. However, even smaller diameter pipes are commonly used in the natural gas industry.

U.S. Pat. No. 9,539,697 B2, which is assigned to the assignee of the present application, discloses cold root-rolling devices that are adapted for use with relatively large diameter pipes typically used in the off-shore petroleum industry. While these devices are very useful in cold root-rolling threads of larger diameter pipes (e.g. those having diameters on the order of 3½ to 8⅝ inches), the physical size of such devices preclude their use on internal threads of smaller diameter pipes (e.g., those having diameters on the order of 2⅜ to 2⅞ inches), such as those used in on-shore gas drilling operations.

Accordingly, it would be generally desirable to provide improved devices that are particularly adapted for use in, but not limited to, cold root-rolling freshly-cut or re-cut threads on objects having smaller diameters.

DISCLOSURE OF THE INVENTION

With parenthetical reference to the corresponding parts, portions or surfaces of the disclosed embodiment, merely for purposes of illustration and not by way of limitation, the present invention provides improved devices (10) for burnishing, and, more particularly, for cold root-rolling, a surface (111, 112) on a smaller diameter object (108), such as threaded surface in a pipe used in an on-shore gas drilling operation.

In one form, the improved device (10) broadly includes a body (11) having a passageway (25), and having a cylindrical opening (41) communicating with the passageway; an accumulator piston (65) mounted on the body for sealed sliding movement within the passageway; a coarse adjustment screw (13) threadedly mounted on the body; a resilient member (14) acting between the coarse adjustment screw and the accumulator piston; a lever (12) pivotally mounted on the body, with the lever having a forward portion (49) extending beyond the body and having a rearward portion (48) generally aligned with the cylindrical opening; a chamber (32) communicating with the accumulator piston; an actuator piston (78) mounted on the body for sealed sliding movement within the cylindrical opening toward and away from the rearward portion (48) of the lever; and a roll (15) rotatably mounted on the forward portion (49) of the lever. The chamber is completely filled with liquid. The position of the coarse adjustment screw relative to the body may be selectively adjusted to controllably vary the fluid pressure within the chamber. The device may be mounted on a machine tool and selectively moved toward the object to burnish a surface (111, 112) with controllable force along a length of the surface when the object and device are rotated relative to one another.

The roll (15) may be a thread roll for burnishing the threads of an object, or the roll may be configured to burnish a non-threaded surface on an object. The non-threaded surface may be adjacent to a threaded surface. The roll may have an asymmetric configuration. The forward portion of the lever may have a pocket adapted to receive a holder (16) for the asymmetric roll. The roll holder may have an asymmetric configuration complementary to the asymmetric configuration of the roll such that the roll may only be inserted into the holder when the roll is in a proper orientation relative to the actuator piston.

The object may be configured to have an internal thread with an inner diameter of between about 2⅜ inches and about 2⅞ inches. However, this size range should not be viewed as a limitation to the scope of the appended claims unless a range to that effect appears explicitly therein.

The device may further comprise a pressure gauge (18) arranged to measure and indicate the liquid pressure (in psi) within the chamber. The device may be arranged such that the lever is so dimensioned and configured that the pressure gauge will also indicate the force (in $lb_f$) exerted by the roll on the object.

The body and/or lever of the improved device may have a slot (38), and the other of the body and lever may have a pin (40) arranged in the slot to limit pivotal motion of the lever relative to the body. The lever may be an intermediately-pivoted lever.

The resilient member may be a Belleville spring stack. The Belleville spring stack may be preloaded to a range having a substantially-constant force-to-displacement characteristic.

Accordingly, the general object of the disclosure is to provide improved devices for burnishing a surface on an object. In some embodiments, the devices may be configured and arranged to burnish approximately the entire length of the surface of the object.

Another object is to provide improved device for cold root-rolling a thread on a smaller diameter pipe.

These and other objects and advantages will become apparent from the foregoing and ongoing written specification, the drawings, and the appended claims.

DESCRIPTION OF THE PREFERRED EMBODIMENTS

Figure 1:
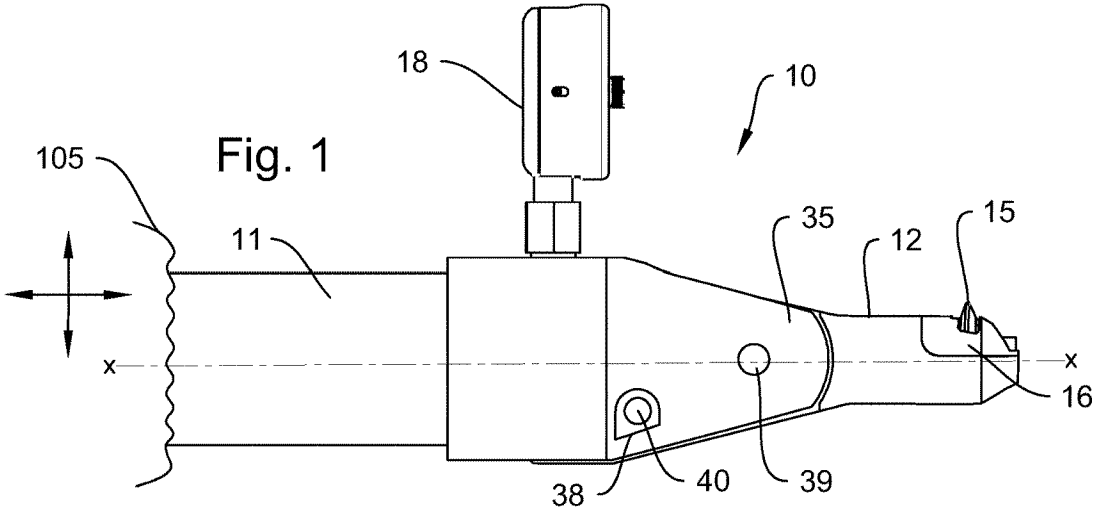
FIG. 1 is a fragmentary side elevation of one embodiment of the improved devices for burnishing a surface on an object.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
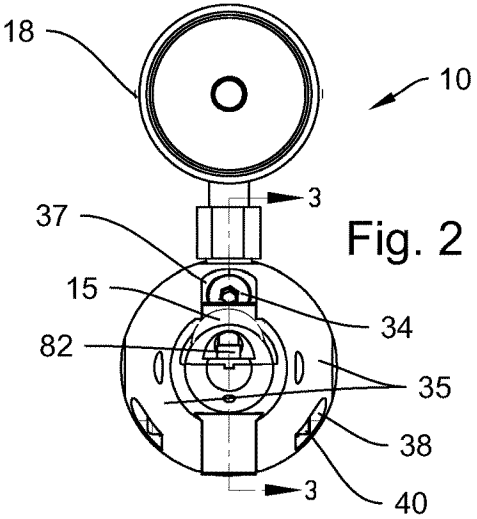
FIG. 2 is a right end elevation of the device shown in FIG. 1.
Figure 3:
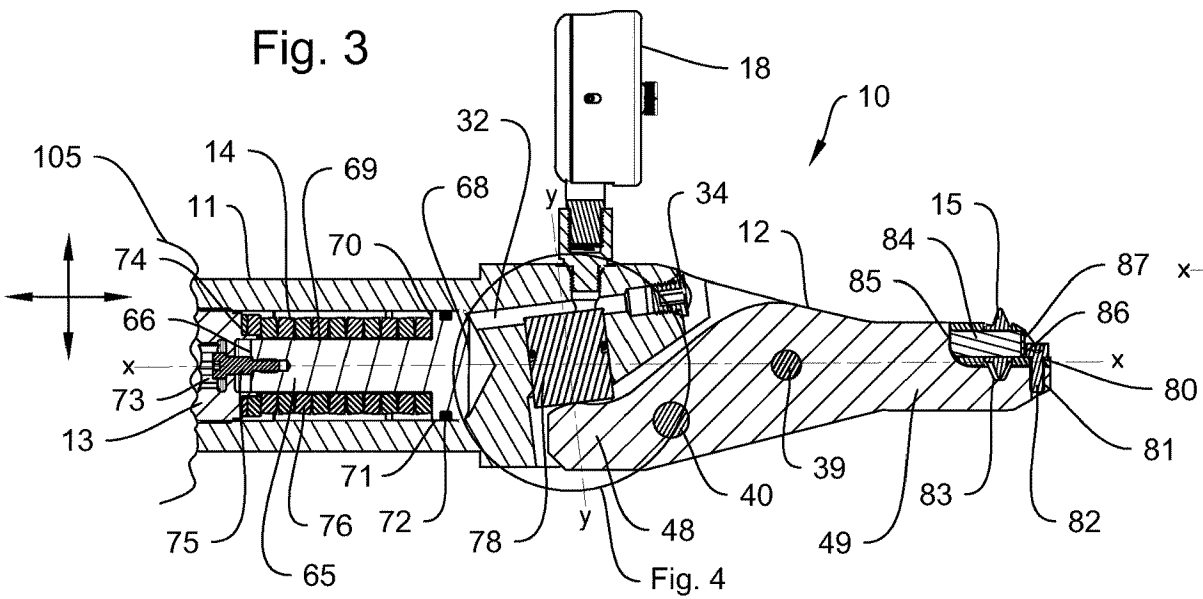
FIG. 3 is a fragmentary longitudinal vertical sectional view thereof, taken generally along line 3-3 of FIG. 2, and showing the pressure gauge partly in section and partly in elevation.

Referring now to the drawings and, more particularly, to FIGS. 1-3 thereof, the present invention provides improved devices that are adapted to burnish a surface on an object with controllable force along the required length of the surface. In FIGS. 1 and 3, a preferred form of the device is generally indicated at 10, and is shown as broadly including a body generally indicated at 11, a lever, generally indicated at 12, mounted on the body, a coarse adjustment screw 13, a resilient member 14, a roll 15, a roll holder 16, and a pressure gauge 18 also mounted on the body.

Body

Figure 5:
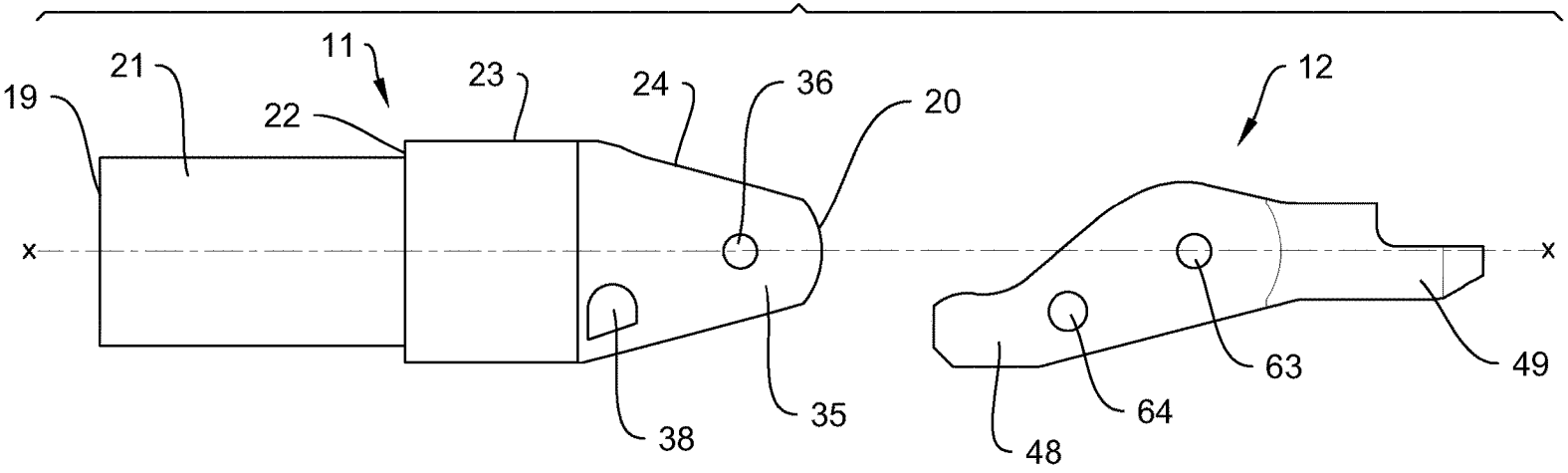
FIG. 5 is a side elevation of a portion of the device shown in FIG. 1, showing the body and the lever in exploded aligned relation.
Figure 6:
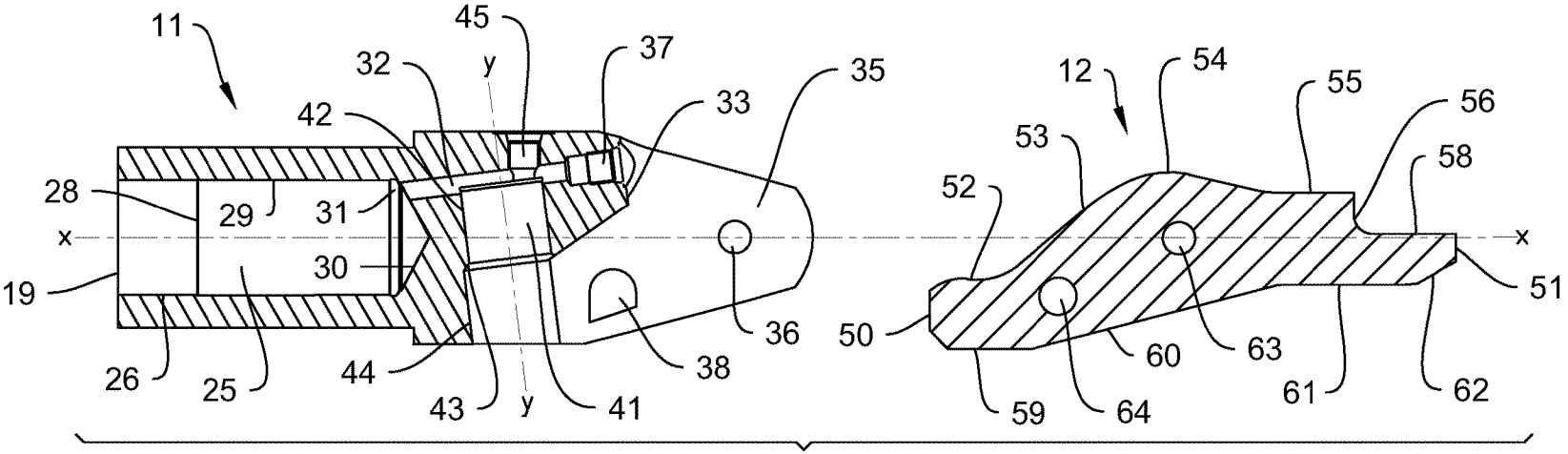
FIG. 6 is a fragmentary longitudinal vertical section of the parts shown in FIG. 5, showing the body and the lever in exploded aligned relation.

Referring now to FIGS. 5 and 6, body 11 is a specially-configured member that is horizontally elongated along axis x-x. The body has an annular vertical left end face 19, a rounded arcuate right end face 20, and an outer surface that sequentially includes (from left to right in FIG. 5), an outwardly-facing horizontal cylindrical surface 21 extending rightwardly from the outer margin of left end face 19, a leftwardly-facing annular vertical surface 22, an outwardly-facing horizontal cylindrical surface 23, and an outwardly- and rightwardly-facing frusto-conical surface 24 joining the outer margin of right end face 20.

As best shown in FIG. 6, the body has an internal passageway, generally indicated at 25, that sequentially includes (again from left to right), an internally-threaded surface 26 extending rightwardly from the inner margin of left end face 19, a leftwardly-facing annular vertical surface 28, a horizontal cylindrical surface 29, and a conical surface 30 generated about axis x-x. A rounded annular groove 31 extends radially into the body from the juncture of surfaces 29 and 30. A chamber, generally indicated at 32, extends rightwardly and upwardly from the upper margin of conical surface 30 and opens onto a surface 33 of the body. A plug 34 (shown in FIG. 3) is threaded into the tapped margin of chamber 32 to close off the hole 37 at surface 33.

Surface 33 is part of a cross-piece between two prong-like fork members 35, 35 that extend further rightwardly. Fork members 35 each include two aligned transverse holes 36, 38. Holes 36 accommodate passage of intermediate portions of a pivot pin 39, and holes 37 accommodate passage of intermediate portions of a stop pin 40, as described in greater detail below.

Another hole 41 extends downwardly and rightwardly from chamber 32 and forms a cylindrical opening in body 11. This cylindrical opening 41 is generated about axis y-y, as shown in FIG. 6. This cylindrical opening includes a cylindrical surface 42 generated about axis y-y and extending downwardly and rightwardly from chamber 32, a downwardly- and rightwardly-facing frusto-conical surface 43, and a cylindrical surface 44 continuing downwardly therefrom and joining body outer surface 23.

Another tapped hole 45 extends downwardly from body surface 23 to communicate with chamber 32. This hole 45 accommodates the threaded margin 46 (shown in FIG. 4) of pressure gauge 18. Thus, the pressure gauge communicates with chamber 32, which in turn communicates with passageway 25 and cylindrical opening 41.

Lever

Still referring to FIGS. 5 and 6, lever 12 is shown as being a specially-configured horizontally-elongated member. The lever has a leftward (or rearward) portion 48 which is adapted to fit between the forks 35, 35 of the body, and has a rightward (or forward) portion 49 extending rightwardly therefrom. More particularly, lever 12 is shown as having a vertical left end 50, a vertical right end 51, and a specially-configured outer surface. The outer surface is not symmetrical about axis x-x. Rather, the upper surface sequentially includes (again from left to right) an upwardly-facing surface 52 extending rightwardly from the outer margin of left end 50, an upwardly- and leftwardly-facing surface 53, an upwardly-facing arcuate surface 54, another upwardly-facing surface 55, a rightwardly- and upwardly-facing inclined surface 56, and an upwardly-facing horizontal surface 58 continuing rightwardly therefrom to join the upper margin of right end 51.

The lower surface of the lever sequentially includes (again from left to right) a downwardly-facing horizontal surface 59 extending rightwardly from the outer margin of left end 50, a downwardly- and rightwardly-facing surface 60, a horizontal surface 61, and a downwardly- and rightwardly-facing inclined surface 62 continuing rightwardly therefrom to join the lower margin of right end 51.

The lever has two transverse holes 63, 64, which are adapted to be aligned with body holes 36, 38 when the left marginal end portion of the lever is inserted between the body forks 35. Aligned holes 36, 63 will accommodate passage of the intermediate portion of pivot pin 39 (shown in FIG. 1). Thus, the lever 12 is pivotally mounted on the body 11 for rotary motion about the axis of pivot pin 39. A stop pin member 40 (also shown in FIG. 1) passes through aligned holes 38, 64. The diameter of hole 64 is just large enough to permit sliding engagement with stop pin 40, while holes 38 are larger than the diameter of stop pin 40. Thus, stop pin 40 acts as a pin in a slot to limit pivotal movement of the lever relative to the body in both counter-clockwise and clockwise directions. Pins 39, 40 may be secured to the devices with a retaining ring or similar retention mechanism when the lever is installed.

Accumulator Piston

Referring now to FIG. 3, the accumulator piston 65 is shown as being a horizontally-elongated member having a somewhat T-shaped cross-section. More particularly, the accumulator piston has an annular vertical left end face 66, a circular vertical right end face 68, and an outer surface that sequentially includes (from left to right) an outwardly-facing horizontal cylindrical surface 69 extending rightwardly from the outer margin of left end face 66, a leftwardly-facing annular vertical surface 70, and an outwardly-facing horizontal cylindrical surface 71 that joins the outer margin of right end face 68. An annular groove extends radially into the piston from surface 71 to receive and accommodate an O-ring 72, which slidably engages surface 71.

Adjustment Screw

Still referring to FIG. 3, the coarse adjustment screw 13 is shown as being a horizontally-elongated externally-threaded member, which is matingly received in body 11. The coarse adjustment screw 13 has an internal polygonal surface 73 and has an annular vertical right end face 74. Polygonal surface 73 is adapted to receive a polygonal turning tool (not shown) by means of which the adjustment screw 13 may be selectively threaded into or out of engagement with the body 11. Adjustment screw 75 serves as an abutment surface for the resilient member, discussed infra. Adjustment screw 75 passes through the coarse adjustment screw and is slidably received in the accumulator piston to limit the leftward position of the accumulator piston.

Resilient Member

Still referring to FIG. 3, the resilient member 14 is shown as being a Belleville spring stack having a plurality of individual Belleville springs, severally indicated at 76. The left end face of the leftward most spring bears against coarse adjustment surface 74. The right end face of the rightward most Belleville spring bears against accumulator piston surface 70.

Actuator Piston

Figure 4:
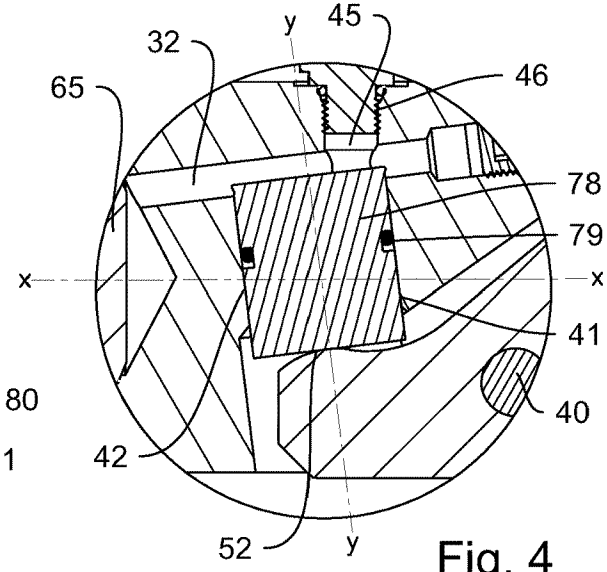
FIG. 4 is an enlarged fragmentary detail view of the body, taken within the indicated circle in FIG. 3, depicting the actuator piston.

As best shown in FIG. 4, chamber 32, as well as hole 41 and the portion of hole 45 above actuator piston 78, is entirely filled with an incompressible liquid. The actuator piston 78 is shown as being slidably received in hole 41 for movement along axis y-y. An annular groove extends radially into the actuator piston from its cylindrical outer surface to receive and accommodate an O-ring 79 which slidably engages surface 42. The lower surface of actuator piston 78 engages lever surface 52 when the lever is pivotally mounted on the body. The forces exerted by the actuator piston 78 can be transferred via the pivotal movement of the lever to the roll.

The surface area of the actuator piston 78 and the configuration of the lever 12 may be chosen such that the value of the force exerted on the roll 15 in pounds of force ($lb_f$), and the value of the pressure (in psi) of the hydraulic circuit, are numerically equal. Thus, the value of pressure displayed on the gauge 18 in psi can also be read as the force ($lb_f$) exerted by the roll on the surface of an object, without the need for numerical conversion or scaling.

Roll Holder and Roll

As depicted in FIG. 1, a roll holder 16 is detachably mounted onto the rightward marginal end portion of the lever 12. Referring back to FIG. 3, the roll holder has a hole 80 and the lever has another hole 81 that aligns with hole 80 when the roll holder is mounted on the lever. The roll holder may be secured to the lever with a fastener 82 (such as a screw) that is threadedly mounted through aligned holes 80, 81. Leftwardly from hole 81, the lever also has a groove 83 that extends radially downwardly from the roll holder. Groove 83 is configured to receive and accommodate roll 15, such that the roll may freely rotate about a roll axle 84.

The left end surface of roll axle 84 engages a rightwardly-facing vertical surface 85 of roll holder 16, and the right end surface of roll axle 84 engages a leftwardly-facing vertical surface 86 of fastener 82. A semi-cylindrical surface 87 on the right end of the roll axle 84 enables the close engagement of the roll axle with the cylindrical head of the roll holder fastener 82 at surface 86. Thus, the movement of roll axle 84 linearly along axis x-x is restricted and the roll axle is secured to the roll holder.

Figure 7:
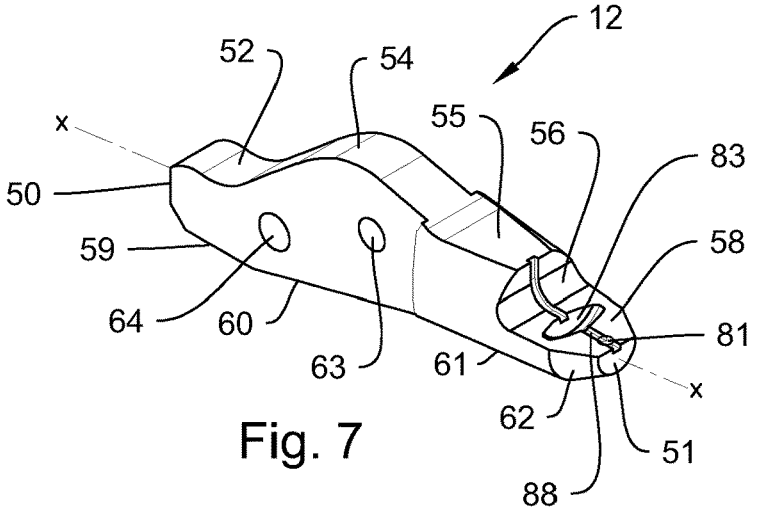
FIG. 7 is an isometric view of the lever shown in FIG. 5, looking at the right front corner thereof.

Turning to FIG. 7, the forward marginal end portion 49 of lever 12 is shown in greater detail. The roll holder is detached from the lever and is not shown in FIG. 7. Hole 81 and groove 83 are shown extending downwardly through lever surface 58. The lever has a narrow and shallow slot-like keyway 88 that cuts through a middle section of surfaces 56, 58. Slot-like keyway 88 runs at a constant depth and along axis x-x from the rightward margin of surface 55 to right end 51. The slot-like keyway is configured to help align and secure the roll holder to the lever, as is described in further detail below.

Figure 8:
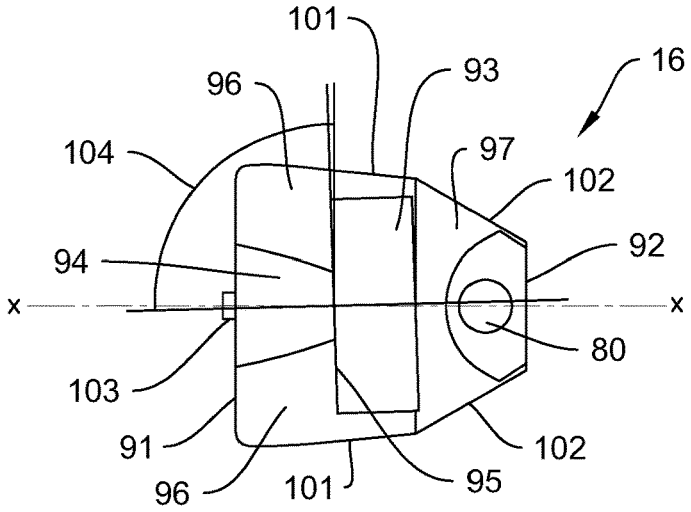
FIG. 8 is an enlarged top plan view of the roll holder, showing the asymmetric angle of the roll holder.
Figure 9:
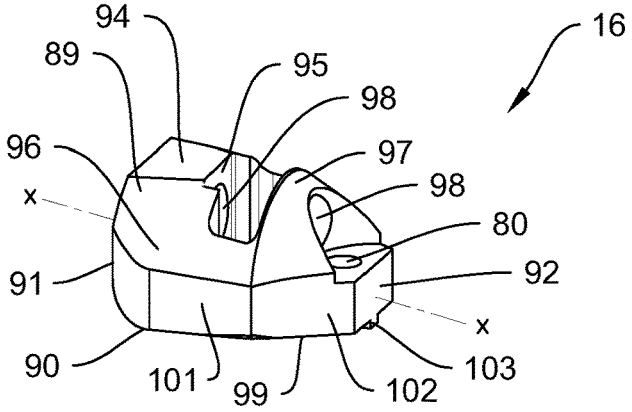
FIG. 9 is an enlarged isometric view of the roll holder shown in FIG. 8, looking at the right front corner thereof.

Now referring to FIGS. 8 and 9, one embodiment of the roll holder 16 is shown as being a specially-configured horizontally-elongated member. The roll holder has an upper portion 89, a lower portion 90, a leftwardly-facing vertical end face 91, a rightwardly-facing vertical end face 92, and a hole 93. Hole 93 is configured to receive and accommodate roll 15.

Upper portion 89 has an outwardly-facing horizontal top face 94 that extends from the top of left end face 91 to a rightwardly-facing vertical surface 95. Two corresponding cylindrical surfaces 96 extend downwardly and outwardly from top face 94, continuing around hole 93 to join with lower portion 90 and an outwardly-facing cylindrical surface 97. Upper portion 89 further includes two transverse holes 98 that extend generally along axis x-x and are configured to receive roll axle 84.

As best shown in FIG. 9, lower portion 90 is a shelf-like extension below upper portion 89. This elongated shelf will cause the roll to be positioned in a vertically-extended direction relative to the lever when the roll holder is installed on the device. The extent of elongation may correspond with the dimensions of the object to be rolled. The roll holder may thus be configured to extend the reach of the roll outwards and allow the devices to accommodate the surfaces of a plurality of objects each having differently-sized interior diameters.

Lower portion 90 has a horizontal lower surface 99 and an outer surface that sequentially includes (again from left to right) left end face 91, two corresponding outwardly-facing vertical surfaces 101, and two additional outwardly-facing vertical surfaces 102 that join right end face 92. Fastener hole 80 extends through lower portion 90, perpendicular to the roll axle holes 98.

The lower portion 90 further comprises a narrow key 103 that extends outwardly from the left margin of top face 94, downwardly along left end face 91, and rightwardly along lower surface 99 to join the lower margin of right end face 92. Key 103 is configured to mate with slot-like keyway 88 of the lever. Thus, when the roll holder is attached to the lever and secured with fastener 82, the roll holder will be properly aligned, and movement of the roll holder relative to the lever is restricted.

Alignment of the Roll

Due to design constraints related to burnishing the surfaces on certain kinds of smaller diameter objects, such as pipes having internally-threaded surfaces, rolls may have to be tilted at an angle (e.g., corresponding to the helix of the thread to be rolled). Accordingly, the present disclosure provides for devices configured and arranged with specially-configured roll holders. Still referring to FIGS. 8 and 9, vertical surface 95 of hole 93 is not normally aligned along axis x-x. Rather, as shown in FIG. 8, vertical surface 95 is aligned at an angle 104 relative to axis x-x. Angle 104 is shown to be approximately 91.57 degrees, which represents a tilt of approximately 1.57 degrees. The roll axle holes 98 will also be aligned with vertical surface 95. Thus, the roll may be installed in the roll holder at the desired angle, such as an angle corresponding to the helix of a thread to be rolled.

Operation

The device 10 is assembled as shown in the drawings. The chamber is entirely filled with liquid. The coarse adjustment screw is threaded onto the body to vary the pressure of the liquid within the chamber. The pressure of the liquid in the chamber pushes the actuator piston downwardly along axis y-y to engage the rearward (i.e. leftward in FIGS. 3 and 4) portion of the lever 12. This forces the rearward end 48 of the lever downwardly, and causes the lever to pivot in a counter-clockwise direction about pivot pin 39. This urges the forward end 49 of the lever (i.e. the right end as shown in FIGS. 3 and 4) to move upwardly about pivot pin 39. Thus, the pressure within the chamber biases the lever to pivot in a counterclockwise direction about pivot pin 39 to urge the roll 15 into engagement with the surface to be rolled.

Figure 10A:
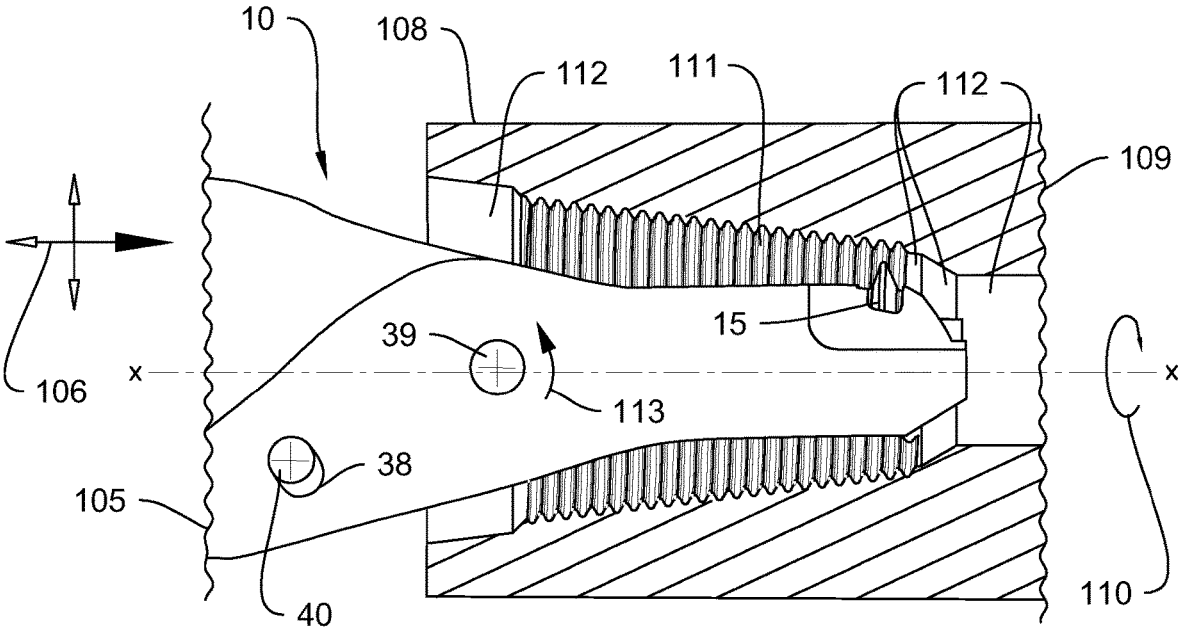
FIG. 10A is an enlarged fragmentary side elevation of the device shown in FIG. 1 being inserted into an object, showing the object in section, and showing the lever as having been moved in a counterclockwise direction prior to the engagement of the roll with a surface on the object.
Figure 10B:
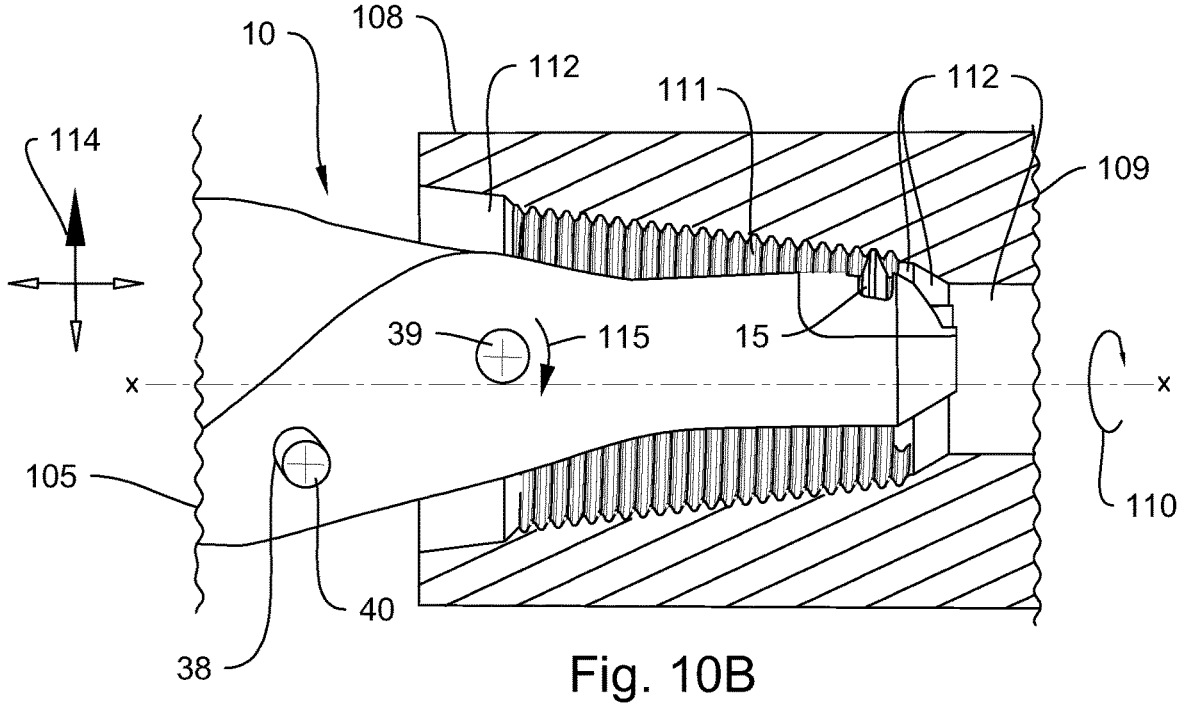
FIG. 10B is an enlarged fragmentary side elevation of the device, similar to FIG. 10A, but showing the device as having been moved upwardly to engage the surface of the object, and showing the lever as having been moved in a clockwise direction relative to the body to a maximum pivot position, with the roll forcibly bearing against the surface of the object.

The operation of the devices is illustrated in FIGS. 10A and 10B. FIG. 10A shows one embodiment of the device as having been operatively mounted on a machine tool 105 that provides for rectilinear movement of the device along direction arrows 106. The device may be selectively moved toward an object 108, as indicated by the bolded directional arrow. Object 108 is shown as being a horizontally-elongated member operatively mounted on machine 109 for rotational movement of the object about axis x-x along the direction of arrow 110. The object is also shown as having internally-threaded surface 111 and several smooth surfaces 112 extending leftwardly and rightwardly therefrom.

More particularly, FIG. 10A shows the machine tool 105 as having been operated to insert the device into a length of pipe such that the roll is aligned with an internal annular surface of the pipe to be rolled. The roll may engage the root radius of the internal thread (or other internal surfaces adjacent thereto) to be rolled at the deepest and smallest end of the object's thread. The device is shown as having been internally pressurized such that the lever has pivoted in a counterclockwise direction generally along arrow 113. The stop pin 40 has engaged the upper portion of holes 38.

FIG. 10B shows the machine tool 105 as having moved the device upwardly along bolded directional arrow 114 to cause the roll to engage the surface 111 of the pipe. As this occurs, the lever pivots in a clockwise direction, as indicated by arrow 115, about pivot pin 39 until stop pin 40 prevents the lever from further rotation. The resilient member in the body of the device is further compressed. However, the Belleville spring stack is preloaded to operate in the substantially horizontal portion of its force-to-displacement curve. Thus, the roll 15 will be urged into engagement with the object surfaces 111, 112 with substantially constant force when the object and device are rotated relative to one another.

The roll may be a thread roll if it is desired to engage the threaded surface 111, as in rolling those threads, or may have some other configuration if it is desired to engage surfaces 112 or some other surface of the object 108. Thus, the roll is urged into engagement with the surface on the object. At the same time, the object is rotated about axis x-x, to cause the roll to burnish the surface against which the roll engages. Machine tool 105 may subsequently move the device leftwardly or rightwardly along axis x-x to burnish adjacent portions of surfaces 111.

The improved devices 10 may be configured and arranged to apply a substantially constant burnishing force to a surface on an object through use of a lever 12 and appropriately-sized actuator piston 78 to a achieve a ratio of force applied to hydraulic pressure out equal to 1 $lb_f$=1 psi. In some embodiments, the devices 10 may operatively provide for the cold root-rolling of an internally threaded surface 111 of an object 108 (such as a pipe), with controllable and verifiable force, with such object 108 having a relatively small diameter opening. In some embodiments, the inner diameter of the object 108 to be burnished is between two and four inches. In particular cases, the devices 10 may be configured to engage an object having about a 2⅞ inch inner diameter or another object having about a 2⅜ inch inner diameter.

Asymmetric Roll Loading

Each roll holder 16 is preferably equipped with an asymmetric roll loading configuration, allowing for substantially error-free installation of rolls into a roll holder. In particular, Applicants' improved attachment uses an asymmetric roll holder, along with asymmetric hub geometry on the rolls themselves, to insure that the rolls will only mount on the attachment in the proper orientation. The preferred embodiment uses a slight step in the lateral wall of roll mounting hole 93 of approximately 0.015 inch, located at some radial distance away from the centerline of the roll mounting axis. The opposing wall has no such step. The preferred embodiment uses a roll 15 with two different hub diameters on its opposite faces. One hub has a radius slightly less than the radial distance. The other hub has a radius slightly greater than radial distance. When a roll with these asymmetric hubs is inserted into a hole with the step, the roll will only align properly with the roll pin axis if the smaller hub is adjacent to the step. If the roll is inserted such that the larger hub is adjacent the step, the hub will make contact with the step prior to alignment of the roll axis with the roll pin hole axis, thus preventing the roll pin form being inserted improperly.

While the preferred embodiment uses two differently-sized hubs on the opposite faces of the roll, persons skilled in this art will readily appreciate that other forms might achieve the same objective; namely, of preventing the roll from being improperly inserted into the pocket. Some alternatives might include, but are not limited to, the provision of two steps in the roll mounting hole at different radial distances, a tapered roll bore to be used in conjunction with a tapered roll axle, a stepped roll bore to be used with a stepped roll axle, a roll mounting hole with a minimally-enlarged profile similar to the asymmetric thread form on the roll, and the like.

MODIFICATIONS

The present invention expressly contemplates that many changes and modifications may be made. For example, the materials of construction are not deemed critical. The length of any part, and its proportion and degree relative to another part, is not deemed critical. The passageway and the chamber may be formed by other techniques than that shown. The object is not limited to being a length of pipe.

As earlier described with reference to FIG. 9, roll holder 16 may be configured with lower portion 90 sized according to the dimensions required by the inner diameters of the object to be rolled. For example, the roll holder lower shelf portion may be sized to generally align the upper surface of the roll holder with the upper surface of the lever (as shown in FIGS. 1, 10A, and 10B). In other embodiments, the roll holder may be sized to extend the position of the of the roll relative to the lever upwardly, such that the devices may be configured to receive objects having differently-sized inner diameters.

Different roll holder embodiments may yield slightly different pressure readings based on where the roll 15 sits in relation to the lever 12. When taken into account with other areas of potential loss in the disclosed system, this change in force is negligible.

In some embodiments of the device, the roll holder may be permanently integrated with the lever. In one preferred embodiment, the roll holder 16 is modular, replaceable by similar but different components, each designed to accommodate various sizes of rolls 15, objects 108 having different geometries, and changeable thread 111 helix angles. Roll holders may be cut to the approximate angle of the thread they are needed for.

Key 103 may be comprised of a plurality of spaced-apart keys instead of being a single continuous projection. The resilient member 14 can be a Belleville spring, a Belleville spring stack, a die spring, a machined spring, a bellows, or a pneumatic device filled with a charge gas, such as nitrogen.

One roll holder embodiment may allow the devices to be configured to root roll an object having about a 2⅜ inch NPT (or American Petroleum Institute, "API") connection, while another embodiment of the roll holder may be used for an object having about a 2⅞ inch NPT/API connection.

The surface area of the actuator piston 78 may be approximately one square inch, or it may be other than approximately 1 square inch. In either case, the ratio of the lever 12, as defined by the length of the forward end 49 divided by the length of the rearward end 48, may be calculated to match the numerical value of the surface area of the actuator piston 78, such that the value (in $lb_f$) exerted upon the roll 15, and the value of the pressure (in psi) of the hydraulic circuit are numerically equal. Thus, the value displayed on the pressure gauge 18 in psi can be read as the $lb_f$ exerted by the roll 15 on the object 108 surface 111 without the need for numerical conversion or scaling.

The coarse adjustment screw 13 may be adjusted to allow a user to tune the device 10 pressure to within approximately one hundred pounds of force. Plug 34 may be replaced with a fine adjustment screw (not shown), such that the pressure within chamber 32 may be controlled with a greater degree of precision. For example, a user may be able to further tune the device pressure to within approximately ten pounds of force.

The device 10 is shown in FIGS. 3 and 6 as having a hole 37 provided in the body 11 so as to communicate with the chamber 32. This hole 37 may be identical to the hole 45 such that the pressure gauge 18 and the closure plug 34, as described infra, may be interchangeably threaded into engagement with the body 11 in either of these openings 37, 45.

The coarse adjustment screw 13 may be threaded into the body 11 to selectively vary the preload of the Belleville spring stack 14. In the preferred embodiment, the Belleville spring stack 14 operates in the linear portion of its force-to-displacement characteristic. Optionally, the Belleville spring stack 14 can be preloaded such that it is substantially in the horizontal range of its force-to-displacement characteristic, regardless of its displacement. This means, for all intents and purposes, that when the Belleville spring stack 14 is so preloaded, it exerts substantially constant force on the accumulator piston 65. Otherwise stated, the accumulator piston 65 may be displaced leftwardly against the urging of the Belleville spring stack 14 with substantially constant force, regardless of the spring stack displacement.

CONCLUSION

The space-saving design of the preferred embodiment has minimal fasteners, to allow for its use in smaller workplaces. The single threaded fastener 82 of the roll holder 16 has the triple function of (i) attaching the roll holder to the lever 12, while also (ii) providing a means to retain the roll axle 84, and (iii) to prevent the non-axial rotation of the roll 15.

The lever 12 may be mounted on the body 11 such that the pivot pin 39 is positioned directly between the roll 15 and the actuator piston 78. This may be done to preserve the use of the current gauges and hydraulic parts found in other cold roll tools. Also, when combined with a one square inch actuator piston 78, the numerical values of pressure as read on the pressure gauge 18 will be the numerical value of pounds of force, with no scaling factor or conversion required. One psi of pressure will be equal to one $lb_f$. This simplifies the operation of the devices, and eliminates a potential source of calculation error.

Therefore, the present invention broadly provides improved devices adapted to be mounted on a machine tool and burnish a surface on an object with controllable force along the required length of the surface. The surface may be the thread of a pipe and areas adjacent thereto. The devices may include a body having a passageway, and having a cylindrical opening communicating with the passageway; an accumulator piston mounted on the body for sealed sliding movement within the passageway; a coarse adjustment screw threadedly mounted on the body; a resilient member acting between the coarse adjustment screw and the accumulator piston; a lever pivotally mounted on the body, the lever having a forward portion extending beyond the body and having an rearward portion aligned with the cylindrical opening; a chamber communicating with the accumulator piston; an actuator piston mounted on the body for sealed sliding movement within the cylindrical opening toward and away from the rearward portion of the lever; a roll rotatably mounted on the forward portion of the lever; wherein the chamber is completely filled with liquid; wherein the position of the coarse adjustment screw relative to the body may be selectively adjusted to controllably vary the fluid pressure within the chamber; and whereby the devices may be selectively moved toward the object to burnish the surface with controllable force along a length of the surface when the object and device are rotated relative to one another.

Upon information and belief, the present invention has a number of points of patentable distinction over the prior art root-rolling devices for smaller diameter pipes. These include: (i) a combination of a lever arm and hydraulics to impart rolling pressures on surfaces of smaller diameter objects, and (ii) the use of a lever from the tip of the roll to the actuator piston that is configured and arranged to provide gauge measurements that directly correspond to what the roll sees, while utilizing a self-contained pressurization system, thus allowing for conversion-free force measurement.

As to the first point, no known item of prior art uses a self-contained pressure generation device, or a self-contained fluid accumulator, in a device designed to root-roll threads of smaller diameter objects. This obviates the need for an external pressure pump, an external accumulator, and various hose connections, disconnect fittings, and valves. This simplifies installation and use, and removes considerable clutter from the work zone of the machine tool.

As to the second point, no known item of prior art is constructed in such a way as to obviate the need to convert the numerical value of indicated pressure into pounds of burnishing force. The standards governing this cold root-rolling operation, specifically the T. H. Hill specification DS-1, require that a minimum force be applied for each of the various thread sizes. However, since the prior art devices for root-rolling smaller diameter threads have no means for measuring force directly, they usually measure the hydraulic pressure instead, and then use a chart to convert the pressure recorded to the calculated force. In Applicants' devices, pressure is also recorded. However, the working piston has been sized such that its surface area is exactly one square inch, combined with the use of a lever that is configured and arranged such that the numerical values of pressure will also be the numerical value of pounds of force, with no scaling factor or conversion required. One psi of pressure (as measured by the pressure gauge) will be equal to one pound of force (applied by the roll to the surface of an object). This simplifies the operation of the devices, and eliminates a potential source of calculation error.

Therefore, while the presently-preferred form of the devices have been shown and described, and several modifications and alternatives discussed, persons skilled in this art will readily appreciate that various additional changes and modifications may be made without departing from the scope of the invention, as defined and differentiated by the following claims.

What is claimed is:

1. A device adapted to be mounted on a machine tool and burnish a surface on an object with controllable force along a length of said surface, comprising:

a body having a passageway, and having a cylindrical opening communicating with said passageway;

an accumulator piston mounted on said body for sealed sliding movement within said passageway;

a coarse adjustment screw threadedly mounted on said body;

a resilient member acting between said coarse adjustment screw and said accumulator piston;

a lever pivotally mounted on said body, said lever having a forward portion extending beyond said body and having an rearward portion aligned with said cylindrical opening;

a chamber communicating with said accumulator piston;

an actuator piston mounted on said body for sealed sliding movement within said cylindrical opening toward and away from said rearward portion of said lever;

a roll rotatably mounted on said forward portion of said lever;

wherein said chamber is completely filled with liquid;

wherein the position of said coarse adjustment screw relative to said body may be selectively adjusted to controllably vary the fluid pressure within said chamber; and whereby said device is selectively moved toward said object to burnish said surface with controllable force along said length of said surface when said object and device are rotated relative to one another.

2. A device as set forth in claim 1, wherein said surface is located proximate a thread on said object.

3. A device as set forth in claim 1, wherein said roll is a thread roll, wherein said surface is a threaded surface, and wherein said device is configured to root-roll said threaded surface.

4. A device as set forth in claim 1, wherein said roll has an asymmetric configuration;

wherein said forward portion of said lever has a pocket adapted to receive a holder for said roll; and wherein said holder has an asymmetric configuration complementary to said asymmetric configuration of said roll such that said roll may only be inserted into said holder when said roll is in said proper orientation relative to said actuator piston.

5. A device as set forth in claim 1, wherein said object has an internal diameter of between about 2⅜ inches and about 2⅞ inches.

6. A device as set forth in claim 1 and further comprising:

a pressure gauge arranged to measure and indicate the liquid pressure within said chamber.

7. A device as set forth in claim 6, wherein said lever is so dimensioned and configured that said pressure gauge will indicate the force exerted by said roll on said object.

8. A device as set forth in claim 7, wherein said pressure gauge indicates pounds per square inch, and wherein said force exerted by said roll on said object in pounds is numerically equal to the pressure indicated on said pressure gauge.

9. A device as set forth in claim 1, wherein one of said body and lever has a slot, and the other of said body and lever has a pin arranged in said slot to limit pivotal motion of said lever relative to said body.

10. A device as set forth in claim 1, wherein said lever is an intermediately-pivoted lever.

11. A device as set forth in claim 1, wherein said resilient member is a Belleville spring stack.

12. A device as set forth in claim 11, wherein said Belleville spring stack is preloaded to a range having a substantially constant force-to-displacement characteristic.

13. A device a set forth in claim 1, wherein said surface is burnished along approximately the entire length of said surface.

* * * * *